US011878851B2

(12) United States Patent
Autajon

(10) Patent No.: US 11,878,851 B2
(45) Date of Patent: Jan. 23, 2024

(54) PACKAGING FOR INDIVIDUAL ARTICLES WITH USE INDICATOR INSERT AND ASSEMBLY OF SUCH A PACKAGING WITH THE ARTICLES

(71) Applicant: LAGORA, Luxembourg (LU)

(72) Inventor: Gérard Autajon, Montelimar (FR)

(73) Assignee: LAGORA, Luxembourg (LU)

( * ) Notice: Subject to any disclaimer, the term of this patent is extended or adjusted under 35 U.S.C. 154(b) by 0 days.

(21) Appl. No.: 17/978,386

(22) Filed: Nov. 1, 2022

(65) Prior Publication Data

US 2023/0140636 A1 May 4, 2023

(30) Foreign Application Priority Data

Nov. 2, 2021 (FR) ..... 2111610

(51) Int. Cl.
*B65D 71/12* (2006.01)
*B65D 5/50* (2006.01)

(52) U.S. Cl.
CPC ..... *B65D 71/125* (2013.01); *B65D 5/5059* (2013.01); *B65D 2401/10* (2020.05); *B65D 2571/0032* (2013.01); *B65D 2571/0066* (2013.01); *B65D 2571/00253* (2013.01)

(58) Field of Classification Search
CPC ..... B65D 5/50; B65D 5/5014; B65D 5/504; B65D 5/5059; B65D 71/00253; B65D 71/0032; B65D 71/0066; B65D 71/125; B65D 2401/00; B65D 5/5038; B65D 71/00
USPC ..... 206/366, 526
See application file for complete search history.

(56) References Cited

U.S. PATENT DOCUMENTS 5,057,282 A * 10/1991 Linder ..... B65D 5/5038 220/507
7,806,262 B2 * 10/2010 Sakai ..... B65D 5/504 206/370

FOREIGN PATENT DOCUMENTS

| | | |
|---|---|---|
| CH | 269 367 | 6/1950 |
| FR | 3 090 592 | 6/2020 |
| GB | 480 808 | 3/1938 |

* cited by examiner

*Primary Examiner* — Bryon P Gehman
(74) *Attorney, Agent, or Firm* — Clark & Brody LP

(57) ABSTRACT

A packaging for packaging a determined number of individual articles includes a packaging case and a use indicator insert, which includes a transverse plate having individual access openings for an individual article, and having, around each individual access opening, an individual precut system, which at least partially surrounds the individual access opening, each individual precut system determining, after breaking, an individual extraction opening which encompasses the individual access opening and which has at least one transverse extraction dimension which is greater than a corresponding transverse dimension of the corresponding individual access opening. The packaging also has anchoring tabs and anchoring slots for ensuring the anchoring of the use indicator insert in the packaging case.

18 Claims, 7 Drawing Sheets

[Fig. 1]
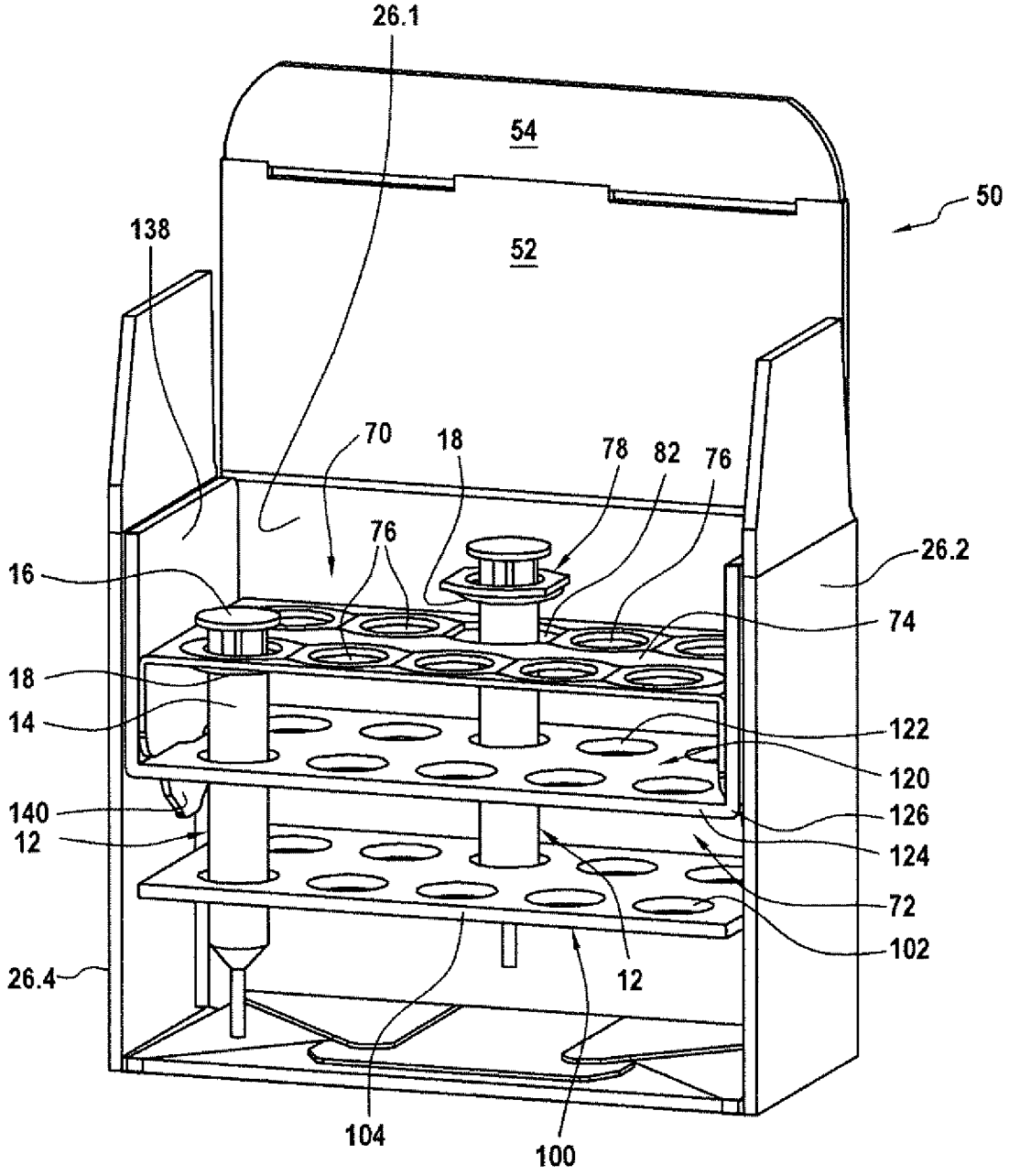

[Fig. 2]
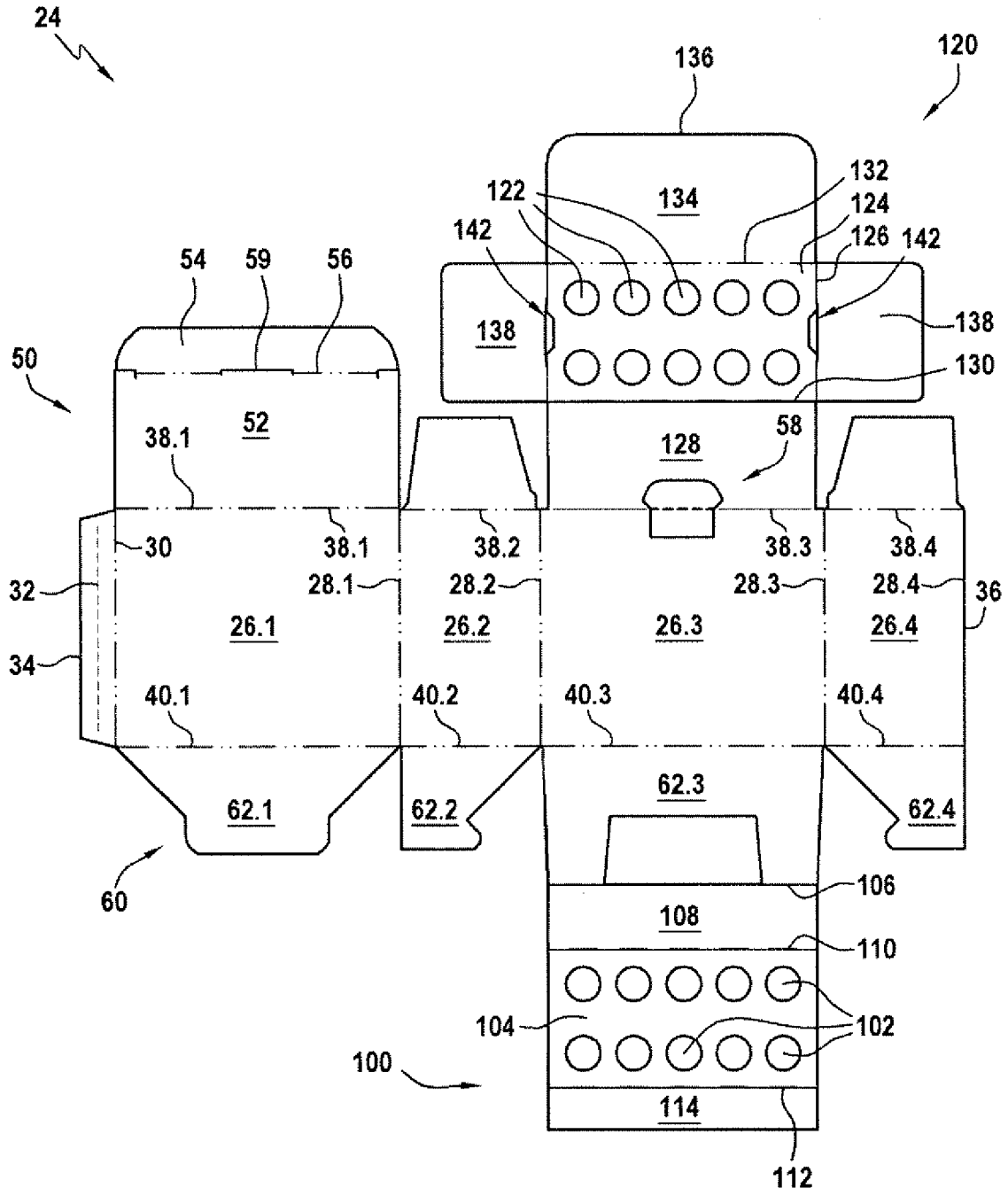

[Fig. 3]
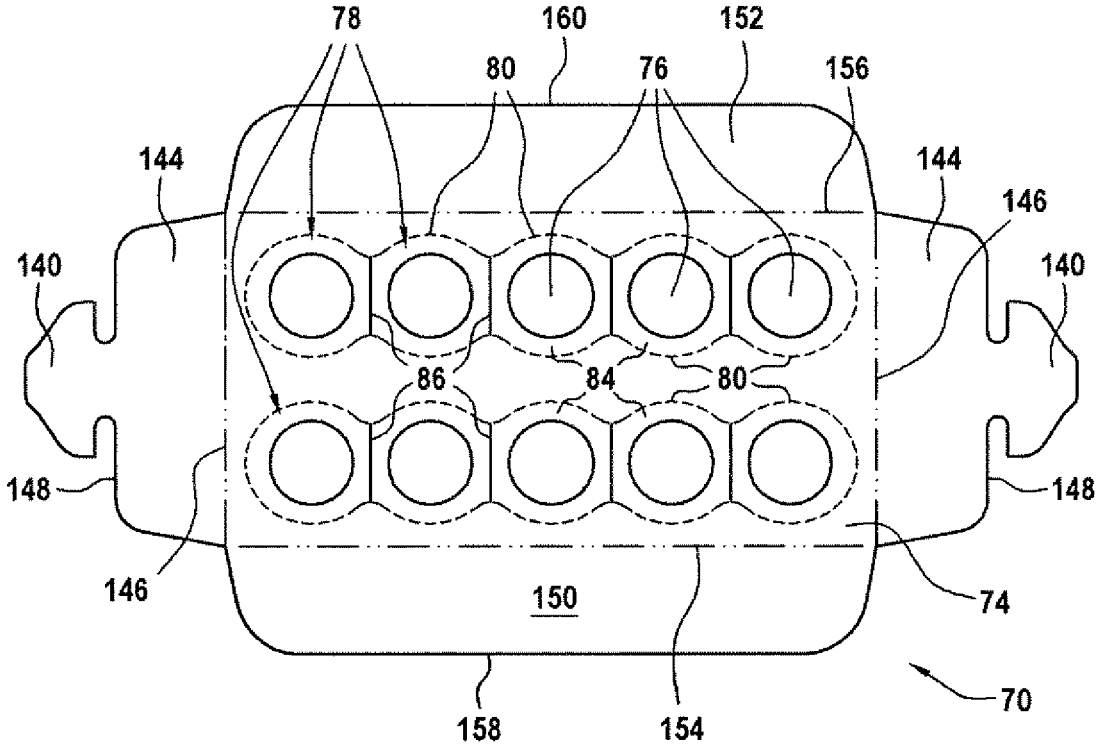
[Fig. 4]
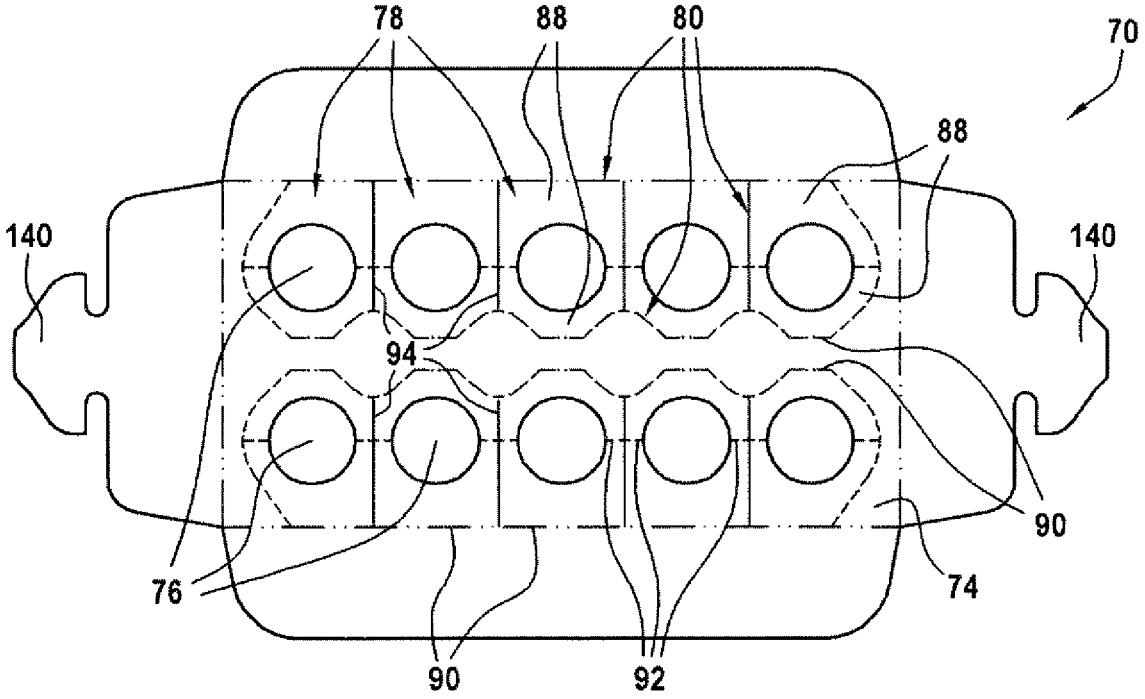

[Fig. 5]
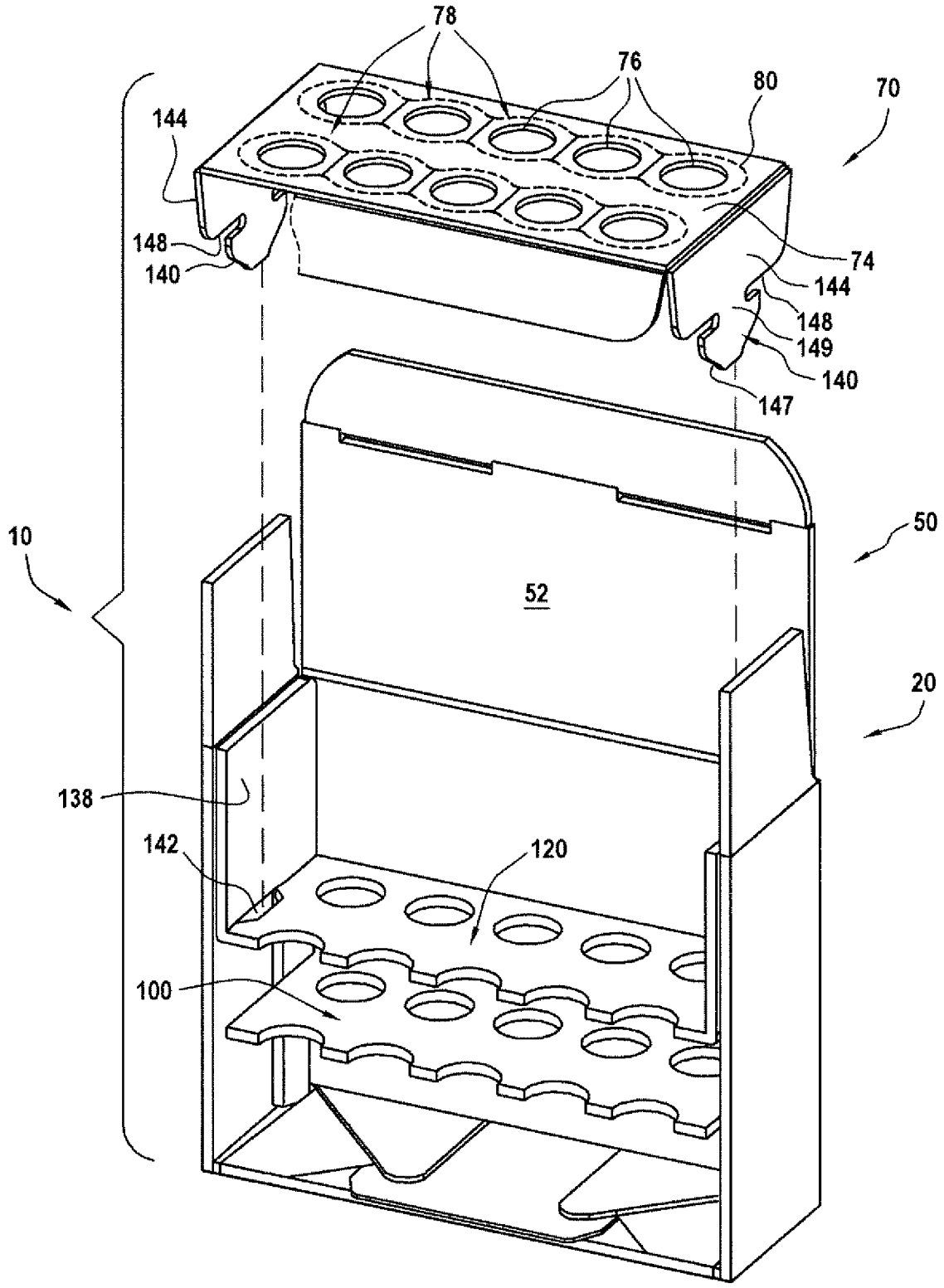

[Fig. 6]
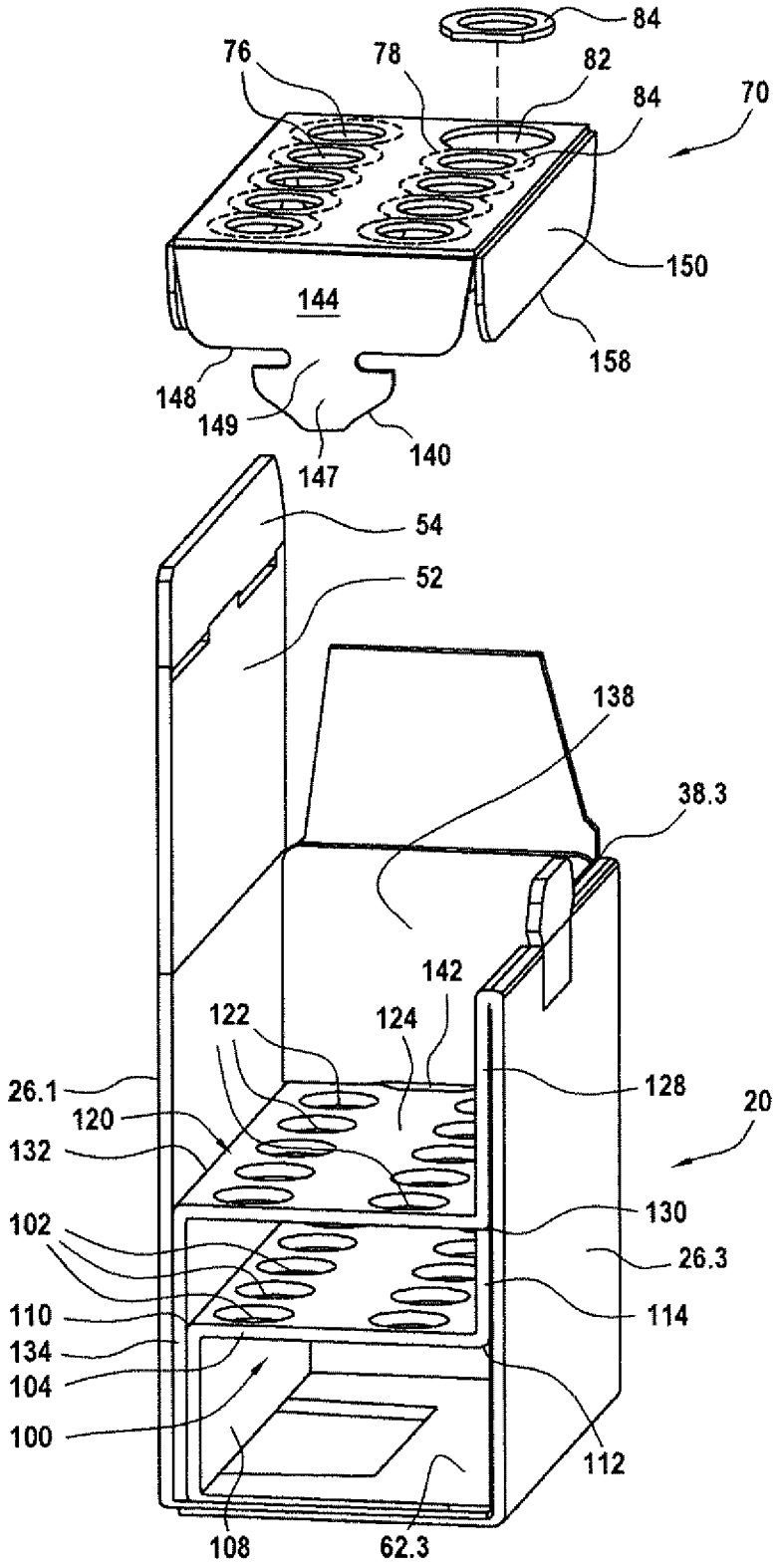

[Fig. 7]
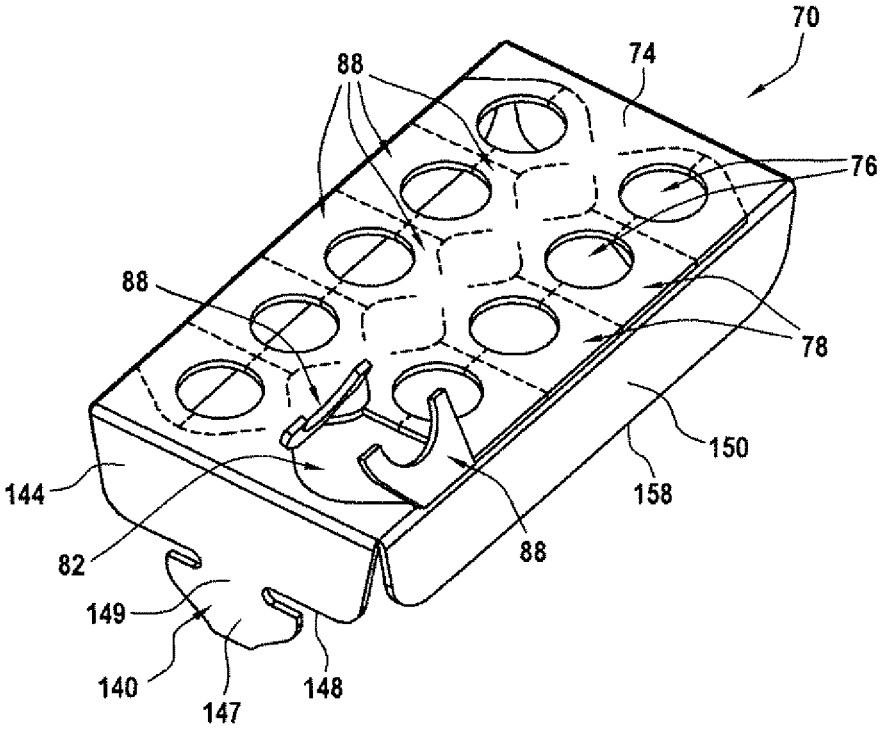
[Fig. 8]
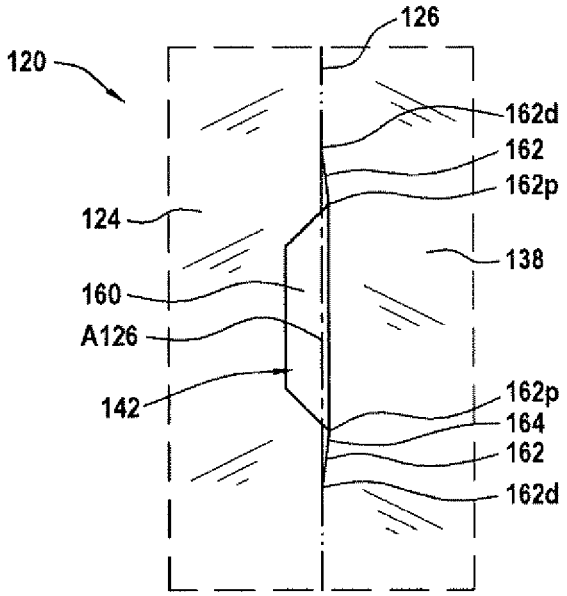

[Fig. 9]
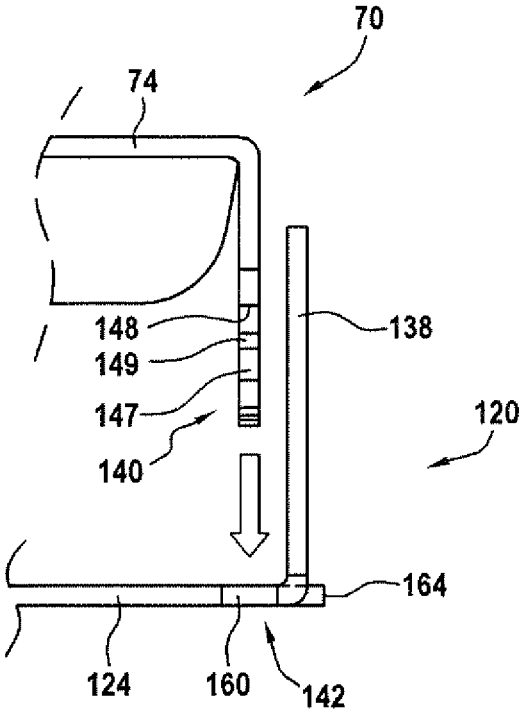

PACKAGING FOR INDIVIDUAL ARTICLES WITH USE INDICATOR INSERT AND ASSEMBLY OF SUCH A PACKAGING WITH THE ARTICLES

TECHNICAL FIELD

The invention concerns the field of cardboard packagings intended to accommodate a predetermined number of individual articles, such a packaging comprising a tubular enclosure obtained by folding at least one blank cut from a sheet of cardboard. Such a packaging is provided, on one side, at a longitudinal end, with an upper opening giving access to an inner space in which the individual articles are intended to be received. The invention more particularly relates to packagings for individual single-use articles. In particular, the invention has a particularly advantageous application in the field of packaging of single-use medical products.

When a packaging is intended to accommodate a plurality of individual articles, the individual articles are intended to be used, therefore to be withdrawn from the packaging, as they are used. In certain cases, after use of an article, the user may be led to replace the article in the packaging. Often, the packaging also comprises internal wedging which has a certain number of wedging shapes, this number being the predetermined number of individual articles that the packaging is intended to accommodate. Initially, each wedging shape accommodates an individual article. However, it becomes practical for the user, after use of the individual article, to rest the used individual article in the packaging, in particular in the wedging shape from which it was extracted.

However, in particular, if single-use individual articles are involved, or sensitive individual articles, it may be necessary, or in any case very useful, to be able to easily identify that an article contained in the packaging has already been withdrawn at least once from the packaging, to show that it has probably already been used. Such an indication enables the user to know instantly whether or not a given article is still unused.

It is noted that this indication, or use indicator, is above all for information purposes and is above all intended to inform a user in good faith. This indication is not necessarily a complete guarantee of non-use.

The aim of the invention is therefore to provide a packaging comprising means for visualising that a determined article, initially contained in a packaging, has been withdrawn at least a first time from the packaging.

DISCLOSURE OF THE INVENTION

For this purpose, the invention provides a packaging for packaging a determined number of individual articles, the packaging comprising a packaging case having an enclosure:

- which is obtained by folding at least one blank cut from a sheet of cardboard,
- which is tubular in a longitudinal direction,
- which has, in a transverse plane perpendicular to the longitudinal direction, a closed polygonal transverse contour around an inner space of the packaging case,
- which comprises an upper opening at a upper longitudinal end of the enclosure and a lower closure at a lower longitudinal end of the enclosure.

The packaging comprises a use indicator insert:

- which is received in the inner space of the packaging case above a lower portion of the inner space, the lower portion of the inner space being intended to receive the individual articles,
- which comprises a transverse plate extending perpendicularly to the longitudinal direction of the enclosure of the packaging case.

The transverse plate is obtained from at least one blank cut from a sheet of cardboard.

The transverse plate has the same number of individual access openings for an individual article, as the determined number of individual articles.

The transverse plate has, around each individual access opening, an individual precut system which at least partially surrounds the associated individual access opening and which comprises at least one or more precut lines, each individual precut system determining, after breaking of the precut line or lines, an individual extraction opening which encompasses the individual access opening and which has at least one transverse extraction dimension which is greater than a corresponding transverse dimension of the corresponding individual access opening.

The packaging also comprises anchoring means for ensuring the anchoring of the use indicator insert in the packaging case.

Such a packaging can furthermore comprise one or other of the following optional additional features, taken alone or in combination.

In certain embodiments, at least one individual precut system completely surrounds the associated individual opening. In certain alternatives of such embodiments, at least one individual precut system comprises a precut line which completely surrounds the associated individual access opening and which delimits, in the transverse plate of the use indicator insert, a ring which, by breaking the precut line, detaches itself from the transverse plate.

In certain embodiments, at least one individual precut system only partially surrounds the associated individual access opening and delimits, in the transverse plate of the use indicator insert, at least one leaf which, after breaking of the precut line or lines, remains attached to the transverse plate by a non-precut connection region, while being able to pivot around a fold line which extends transverse to the connection region. In certain alternatives of such embodiments, the fold line which extends transverse to the connection region is a premarked fold line.

In certain embodiments, the packaging comprises at least one internal wedging of the individual articles, the internal wedging being obtained from at least one blank cut from a sheet of cardboard, and the internal wedging being received in the inner space of the packaging case, and the anchoring means ensure a connection between the use indicator insert and the internal wedging in order to ensure the anchoring of the use indicator insert in the packaging case. In certain alternatives of such embodiments, the anchoring means comprise at least one anchoring tab, integral with one among the use indicator insert and the internal wedging, and an anchoring slot arranged in the other among the use indicator insert and the internal wedging, and the anchoring tab comprises an anchoring shape enabling the insertion of the anchoring tab into the anchoring slot and opposing the withdrawal of the anchoring tab relative to the anchoring slot. In certain of these alternatives, the anchoring slot is arranged at a fold line between a transverse plate and a flap, the fold line defining a folding axis and the flap being folded over towards the direction from which the anchoring tab must be inserted in the anchoring slot, in that the anchoring slot comprises a central lumen and, on each side of the central lumen in the direction of the folding axis, junction cuts which join the corresponding end of the central lumen at the fold line, and the junction cuts have an offset relative to the folding axis, in a direction of the flap, in order to define transverse projections of the transverse plate which prolong the transverse plate beyond the folding axis.

In certain embodiments comprising an internal wedging, the internal wedging is produced in a single piece with the blank from which the enclosure is obtained.

In certain embodiments comprising an internal wedging, the internal wedging has a number of wedging shapes corresponding to the determined number of individual articles.

In certain embodiments, the packaging comprises a lower internal wedging and an upper internal wedging arranged above the lower internal wedging in the inner space delimited by the case, and the anchoring means ensure a connection between the use indicator insert and the upper internal wedging in order to ensure the anchoring of the use indicator insert in the packaging case.

In certain embodiments comprising an internal wedging, the internal wedging determines a position and an orientation of each individual article with regard to an individual access opening associated with this individual article.

In certain embodiments, the use indicator insert is arranged in the packaging at a predetermined distance from the upper longitudinal end of the enclosure, towards the interior in the longitudinal direction.

In certain embodiments, the packaging case and the opening indicator insert are each obtained from separate cardboard blanks. By contrast, in certain embodiments, the packaging case and the opening indicator insert are each obtained from a common cardboard blank.

The invention further concerns an assembly comprising, on the one hand, a packaging as described above and, on the other hand, individual articles contained in the packaging, characterised in that the individual articles have at least one portion which is received in the lower portion of the inner space of the packaging case, said portion having a transverse dimension which is greater than a corresponding transverse dimension of the individual access opening associated with this article.

In certain embodiments of such an assembly, the transverse dimensions of each individual article are less than the transverse dimensions of the corresponding individual extraction openings.

In certain embodiments of such an assembly, the individual articles comprise an upper portion which projects above the use indicator insert.

BRIEF DESCRIPTION OF THE FIGURES

FIG. 1 is a perspective schematic view with a cutaway, showing a packaging according to the invention, in which a first individual article that has never been withdrawn from the packaging and a second individual article that has already been withdrawn from the packaging are shown.

FIG. 2 is a plan view of an exemplary embodiment of a blank for producing a packaging case according to an embodiment of the invention.

FIG. 3 is a plan view of an exemplary embodiment of a blank for producing a first exemplary embodiment of an opening indicator insert for a packaging according to the invention.

FIG. 4 is a plan view of an exemplary embodiment of a blank for providing a second exemplary embodiment of an opening indicator insert for a packaging according to the invention.

FIG. 5 is a perspective schematic view with a cutaway, showing a packaging according to the invention.

FIG. 6 is a perspective schematic view with a cutaway along a plane perpendicular to the cutaway plane of FIG. 5, showing the packaging of FIG. 5.

FIG. 7 is a perspective schematic view of an exemplary embodiment of the blank of FIG. 4, for providing a second exemplary embodiment of an opening indicator insert.

FIG. 8 is a schematic plan view of a detail of an exemplary embodiment of a blank for producing a packaging case having an improved anchoring slot.

FIG. 9 is a schematic side view showing anchoring means comprising an anchoring tab and an anchoring slot, the latter being produced from a blank as illustrated in FIG. 8.

DESCRIPTION OF CERTAIN EMBODIMENTS

The invention relates to a packaging 10 for packaging a determined number of individual articles 12. In the example, each individual article is a syringe 12 comprising a syringe body 14 and a piston 16 which delimits, in the syringe body, a volume filled with a fluid product, in particular a liquid product. In known manner, the syringe body 14 has, at an upper end, a collar 18 enabling the user to counterbalance a pushing force exerted on the piston 16. However, the invention also relates to packagings for other types of individual articles, for example individual flasks, individual tools etc. In many cases, an individual article 12 will be a single-use article. The invention will have particular application in fields requiring that the individual articles have properties of integrity before use, in particular non-contamination properties.

The packaging 10 is intended to contain a determined number, greater than or equal to two, of individual articles 12 that will generally be identical to one another. It is noted, however, that the invention can be implemented for packagings intended to contain several series of individual articles, the individual articles of one series being identical with one another, but the individual articles of two different series optionally being different. In the example, the individual articles of a first series could for example, be syringes, whereas the individual articles of a second series could be the needles intended to be used with these syringes. In the illustrative example, the packaging 10 is provided for a single series of identical individual articles, here for example a number equal to 10 syringes.

The packaging 10 shown in the figures comprises firstly, and mainly, a packaging case 20 having an enclosure 22 which is obtained by folding at least one blank 24 cut from a sheet of cardboard, an example of which is illustrated in FIG. 2. The enclosure 22 is tubular in a longitudinal direction. In the rest of the text, it is considered that, on using the packaging 10, the longitudinal direction corresponds to the vertical direction of terrestrial gravity, while the transverse directions will be the horizontal directions. In the sense of the present text, it is noted that the longitudinal direction is not necessarily the direction along which the packaging has the largest dimension. As will be understood, the longitudinal direction is that which is perpendicular to an opening of the packaging via which the individual articles are intended to be withdrawn.

In the example, the packaging 10 consists exclusively of cardboard and is formed exclusively from one or more blanks cut from a sheet of cardboard. In the example, the packaging 10 consists of two separate blanks, one, an exemplary embodiment of which is illustrated in FIG. 2, is intended to form a case, here comprising, by way of example, wedging means, and the other, two exemplary embodiments of which are respectively illustrated in FIGS. 3 and 4, is intended to form an opening indicator insert 70.

Preferably, the cardboard used for the packaging 10 is a compact cardboard, also called flat cardboard, as opposed to corrugated cardboard. A sheet of compact cardboard thus has a front face and a reverse face, and, in its thickness between the front face and the reverse face, this material has a substantially constant density, as opposed to a corrugated cardboard which comprises empty spaces between its front face and its rear face. However, the packaging according to the invention can also be produced, at least partially, in corrugated cardboard.

Typically, the packaging 10 can be produced in compact cardboard having a grammage in the range from 160 grams per square metre to 600 grams per square metre, preferably in the range from 180 grams per square metre to 400 grams per square metre.

The enclosure 22 has, seen in section through a transverse plane perpendicular to the longitudinal direction, a closed polygonal transverse contour around an inner space of the packaging 20.

In the illustrative example, the tubular enclosure 22 comprises at least four main successive panels 26.*i* (in the illustrated example: 26.1, 26.2, 26.3, 26.4) traversing the closed polygonal transverse contour. In this example, two main successive panels 26*i* traversing the closed transverse contour are connected at a common longitudinal edge, the common longitudinal edge corresponding to a fold line of the sheet of cardboard. In the illustrated example of a flat blank 24, which is delimited by an outer contour along which it has been cut from a sheet of cardboard, the four successive main panels 26*i* are juxtaposed with one another in a transverse direction.

The number of main panels of the tubular enclosure 22 is equal to the number of sides of the transverse polygonal contour of the tubular enclosure 22. In the illustrated example, the number of main panels of the tubular enclosure is equal to four. The transverse polygonal contour of the tubular enclosure is therefore a quadrilateral, preferably a rectangle or a square. However, the number of main panels of the tubular enclosure 22 could be greater than four.

In the plan views of the blanks, the free or cut edges of the blank, in particular of the outer contour, have been shown as thick continuous lines. Predefined fold lines, marked in the material of the blank, to the extent where the blank is not cut or in any case not entirely cut, have been shown as mixed lines. The producing of fold lines may involve one or more techniques, including, for example:

- the kiss-cutting technique, in which the sheet of material is cut, but not through its full thickness;
- marking by crushing material (creasing), etc.

These predefined fold lines of the sheet of cardboard, also called premarked fold lines, facilitate the three-dimensional assembly, but are not intended to be broken during normal use of the packaging.

Also illustrated in the plan views of the blanks, with dashes, are precut lines which are intended to allow tearing of the material along the thus produced precut line.

A precut line is a line along which the material is partially, but not entirely, cut, so as to keep a connection between the two sides of the precut line, this connection however being weakened relative to the strength of the material. Such a precut line can be produced in the form of a kiss-cut, over all or part of the length of the precut line, but is preferably produced in the form of a discontinuous cut along the line, with alternating entirely cut sections and uncut or kiss-cut sections.

The blank 24 of the case 20 therefore comprises, in the illustrated example, four main panels 26.*i* which are juxtaposed and articulated successively one after the other about three parallel longitudinal fold lines 28.*i* (in this case 28.1, 28.2, 28.3). A first fold line 28.1 connects and delimits an end distal main panel, which will here be arbitrarily qualified as the rear main panel 26.1, and an intermediate distal main panel, which will here be arbitrarily qualified as the first side panel 26.2. A second fold line 28.2 connects the first side panel 26.2 to an intermediate proximal main panel, which will here be arbitrarily qualified as the front main panel 26.3, and which is connected along a fold line 28.3 to an end proximal main panel, which will here be arbitrarily qualified as the second side panel 26.4. The fold lines 28.*i* therefore define, in the flat blank 20, longitudinal sides of the corresponding main panels.

The rear main panel 26.1 further comprises a longitudinal side 30 via which it is connected to an assembly flap 32, the longitudinal side 30 corresponding to a fold line between the rear main panel 26.*i* and the assembly flap 32. Transversely opposite the longitudinal side 30, the assembly flap 32 comprises a longitudinal free edge 34, which is a free edge of the blank 24, belonging to the outer contour of the blank 24.

The second side panel 26.4 comprises, transversely opposite the longitudinal side 28.3, a longitudinal side 36 which, in this exemplary embodiment, is a free edge of the blank 24, belonging to the outer contour of the blank 24.

Each of the main panels 26.*i* has opposite upper 38.*i* (in this case 38.1, 38.2, 38.3, 38.4) and lower 40.*i* (in this case 40.1, 40.2, 40.3, 40.4) transverse sides, which are arranged at the longitudinal ends of the corresponding panel. In the text, "upper" designates, in an arbitrary but usual manner, the longitudinal side of the packaging via which it will be opened on use. The concepts of "high", "low", "above", "below", etc. used in this text arise from this concept of "upper".

In the proposed example, the main panels all have the same size in the longitudinal direction so that, in the flat blank 24, the upper 38.*i* and lower 40.*i* transverse edges of the four main panels 26.*i* are respectively aligned along an upper transverse line and along a lower transverse line.

It is understood that the four main panels 26.*i* are intended to form, after folding through 90° around each of the fold lines 28.1, which each therefore become a common longitudinal edge between two successive main panels, a tubular enclosure 22, closed on itself, in which the main panels 26.*i* define the closed polygonal contour around an inner space of the case 20. It is also understood that the assembly flap 32 can itself also be folded through 90° around the fold line 30 in such a way as to be able to be brought into abutment, plane against plane, against the second side panel 26A. Assembly of the assembly flap 32 on the second side panel 26.4, for example by gluing, makes it possible to fix the three-dimensional geometry of the packaging case 20. The fact that the enclosure 22 defines a closed contour does not preclude the main panels, which compose it, from possibly having windows or openings.

Furthermore, the packaging case 20 comprises an opening 50 via which it is intended that the user accesses the individual articles 12 contained in the packaging case 20, and through which the individual articles 12 can be extracted. By convention in this text, this opening is qualified as the upper opening 50 and it is therefore arranged at an upper longitudinal end of the tubular enclosure 22.

The way in which the illustrated blank 24 illustrated and described in detail above is produced, and in particular the arrangement of the main panels relative to the longitudinal direction, is only one exemplary embodiment. Thus, it could be provided that the blank comprises juxtaposed panels in the longitudinal direction which has already been seen, and that is explained further below, that is defined by the position of the opening via which it is envisaged that the user accesses the articles. These panels juxtaposed in the plane could thus comprise, for example, in such a case, an upper panel (forming the upper opening or comprising an arrangement forming the upper opening), a lower panel, and two side or front and rear panels.

The packaging case 20 comprises a lower closure 60 at a lower longitudinal end of the tubular enclosure 22, thus on the side opposite the side of the packaging case 20 where the upper opening 50 is arranged.

In the example, the lower closure 60 of the packaging case 12 comprises as many lower flaps 62.*i* as the number of main panels 26.*i*, i.e., in the illustrated example, four lower flaps 62.1, 62.2, 62.3, 62.4. In this example, each lower flap 62.*i* is connected to a lower transverse edge 40.*i* of one of the main panels 26.*i* of the tubular enclosure 22. During the assembly of the packaging case 20, the lower flaps 62.1 are folded over transversely, at right angles relative to the longitudinal direction, towards the inside of the space delimited by the tubular enclosure 22. The lower flaps 62.1 are folded over with overlap and are assembled together in order to ensure locking of the lower closure 60 of the packaging case 12, either by shape matching or by bonding. The lower closure 60 of the packaging case 20 could be produced in the form of an automatic bottom which deploys automatically during the assembly of the packaging case 10. A person skilled in the art knows numerous ways to produce an automatic bottom with glued flaps.

As can be seen in the figures, the upper opening 50 of the packaging case 12 comprises, in the illustrated example, an upper closure leaf 52 which has a contour identical to the closed transverse contour of the tubular enclosure 22. This upper closure leaf 52 is articulated by an attachment edge on a transverse edge of one of the main panels of the tubular enclosure. In the illustrated example, the upper closure leaf 52 is connected to the rear main panel 26.1 at the upper transverse edge 38.1 thereof, which therefore also forms the attachment edge of the upper closure leaf 52. Preferably, in the blank 10, the upper transverse edge 38.1 of the rear panel 26.1 is therefore in the form of a fold line. Thus, in this example, the upper opening of the packaging, via which a user can extract the individual articles, is formed by opening the upper closure leaf 52, by pivoting it around its attachment edge 38.1.

In other designs of the packaging case 20, the upper opening 50 of the packaging could be arranged in an upper panel of the packaging, for example in the form of a precut line in this panel of the case (this panel being, according to the terminology adopted in this text, an upper panel of the case) so as to delimit in this upper panel for example, an access leaf or hatch to the inner space.

The upper closure leaf 52 comprises an insertion tab 54 which is articulated at a free edge 56 of the upper closure leaf 52, this free edge 56 being opposite the attachment edge 38.1 of the upper closure leaf 52. During the assembly of the packaging case 20, the insertion tab 54 can be folded by 90° around the free edge 56, and the upper closure leaf 52 can be folded over by 90° in order to adopt a horizontal transverse orientation in which the insertion tab 54 is inserted into the inner space delimited by the tubular enclosure 22. In the example, the insertion tab 54 is thus, in the closure configuration of the upper closure leaf 52, engaged in the inner space opposite the inner face of the front main panel 26.3.

However, it is particularly advantageous that the tubular enclosure 22 comprises, at an upper transverse edge of one of the main panels, a locking tab 58 of the upper closure leaf 52. Preferably, this locking tab 58 is arranged at an upper transverse edge of one of the main panels which is opposite that of the main panels to which the upper closure leaf 52 is attached. In this case, in the illustrated example, the locking tab 58 is thus advantageously arranged at the upper transverse edge 38.3 of the front main panel 26.3 of the tubular enclosure 22. The locking tab 58 has a projection which, when the upper closure leaf 52 is in the closure configuration, is intended to be engaged in a slot 59 arranged at the centre of the free edge 56 of the upper closure leaf 52, between the upper closure leaf 52 and the insertion tab 54.

Advantageously, the locking tab 58 can be configured to form a tamper indicator, for example by having the shape of a harpoon. Hence, after a first closure operation of the upper closure 50 of the packaging case 10, the upper closure leaf 52 can be locked in the closure configuration using the locking tab 58, and any attempt at opening will be visible, for example due to the alteration or even a tearing of the locking tab 58. The locking tab 58 can advantageously comprise a line of weakness, for example a precut line, which will be arranged, for example, at the base of the harpoon shape, which will tend to tear easily in the event of an attempt to withdraw the locking tab. Alteration of the locking tab makes the opening of the packaging case 20 immediately visible. On the other hand, if the tamper indicator formed by the locking tab 58 appears intact, this reinforces the confidence of the user in the integrity of the packaging 10 and therefore of its contents.

According to the invention the packaging comprises a use indicator insert 70 for visualising that an individual article 12, initially contained in the packaging, has been extracted therefrom.

In the illustrated embodiments, the use indicator insert 70 is received in the inner space of the packaging, above a lower portion 72 of the inner space, the lower portion 72 of the inner space being intended to receive the individual articles 12.

The use indicator insert 70 comprises a transverse plate 74 which extends perpendicularly to the longitudinal direction of the enclosure of the packaging case. Preferably, the use indicator insert 70 extends over the entire surface of the transverse section of the enclosure 22 such that an individual article cannot be extracted from the lower portion 72 of the inner space of the packaging when the use indicator insert 70 is in place, at least, as will be explained, cannot be extracted without the use indicator insert 70 being clearly and visibly marked by this extraction.

Advantageously, the transverse plate 74 of the use indicator insert 70 is obtained from at least one blank cut in a sheet of cardboard, such as the packaging case 20. In the examples illustrated, the entirety of the use indicator insert 70 is obtained from a single blank. In the examples illustrated, the transverse plate 74 of the use indicator insert 70 is obtained from a blank which is distinct from the blank 24 forming the packaging case 20. However, in certain embodiments, the use indicator insert 70 can also be obtained from the same blank as the packaging case 20.

According to one aspect, the transverse plate 74 of the use indicator insert 70 has the same number of individual access openings 76 to an individual article, as the determined number of individual articles. Each individual access opening 76 has at least one transverse dimension which is less than a transverse dimension of the associated individual article 12. In other words, each individual access opening 76 has a geometry and dimensions which prevent the individual article 12 from being extracted from the packaging 10 through the individual access opening 76 without the use indicator insert 70 being clearly and visibly marked by this extraction. In the illustrated example, the individual access openings 76 are circular openings. These individual access openings 76 are adapted to the individual articles 12 of the example, which are therefore syringes, the syringes having, at their collar 18, a transverse dimension greater than the diameter of the individual access openings 76.

In other words, in general, the individual articles 12 have at least one portion 18 which is received in the lower portion 72 of the inner space of the packaging case 20, and which has a transverse dimension greater than a corresponding transverse dimension of the individual access opening associated with this article.

On the other hand, the transverse plate 74 of the use indicator insert 70 has, around each individual access opening 76, an individual precut system 78 which at least partially surrounds the associated individual access opening 76 and which comprises at least one or more precut line or lines 80.

Each individual precut system 78 determines, after breaking of the precut line or lines, an individual extraction opening 82 which encompasses the individual access opening 76 and which has at least one transverse extraction dimension which is greater than a corresponding transverse dimension of the corresponding individual access opening 76, so as to allow the individual article to pass.

Hence, it is understood that the packaging is designed such that a user is able to grasp an individual article using the access provided by the individual access opening 76. This is done either by accessing the individual article through the individual access opening 76, or because a portion of the individual article 12 projects, out of the lower portion 72 of the inner space, delimited by the opening indicator insert 70, through the individual access opening 76. An individual article 12 is illustrated in FIG. 2, in this case a syringe, which, in a storage configuration, is received in the packaging such that all of the body 14 of the syringe is received in the lower portion 72 of the inner space delimited by the opening indicator insert 70. It is noted that, in this configuration, the collar 18 arranged at the upper end of the body 14 of the syringe is therefore located below the opening indicator insert 70. On the other hand, it is observed that at least a part of the piston 16 of the syringe projects through the individual access opening 76, above the use indicator insert 70, such that it is easily accessible to the user when the upper leaf 52 of the packaging is open. In general, it can therefore be provided that the individual articles 12 each comprise an upper proportion 16 which projects above the use indicator insert 70. The user is therefore able to grasp the individual article 12, in this case the syringe, for example by gripping its piston 16, in order to extract it from the packaging. In the example, the collar 18 of the body 14 of the syringe has a transverse dimension which is greater than the transverse dimension of the individual access opening 76, in this case the diameter of the circular orifice acting as individual access opening 76.

In certain embodiments, at least one individual precut system 78 completely surrounds the associated individual opening.

In the example of FIGS. 1, 3 and 5, an individual precut system 78 comprises a precut line 80 which completely surrounds the associated individual opening 76 and which delimits, in the transverse plate of the use indicator insert, a ring 84 which, by breaking the precut line 80, detaches itself from the transverse plate. In the example, it can indeed be seen that an individual precut system 78 is arranged around the individual access opening 76, in this case in the form of a precut line 80 which extends around the individual access opening 76. In this case, the precut line 80 defines a ring 84 of substantially annular shape. In the example of FIGS. 1, 3 and 5, the precut line 80 is substantially concentric with the circle of the individual access opening 76, but has a larger diameter. It is understood that, when the user extracts the individual article 12 from the packaging, in this case by an upward tensile force, the collar 18 not being able to pass through the individual access opening 76, will cause the precut line 80 which delimits the ring 84 forming the use indicator to break, and will therefore cause the separation of the ring 84 forming the use indicator relative to the transverse plate 74 of the use indicator insert 70. The separation of the ring 84 forming the use indicator clearly and visibly indicates to the user that the individual article corresponding to the individual access opening 76 in question has been extracted from the packaging, even if this article is then replaced in the packaging at the same location. In the example of FIGS. 1, 3 and 5, the ring 84 is therefore intended to be entirely detached from the transverse plate 74 of the use indicator insert 70. Once detached, the ring 84 leaves a space in the transverse plate 74, at the individual extraction orifice 82, the dimensions of which are such that they allow the individual article 12 to pass without difficulty. In other words, the transverse dimensions of each individual article 12 are less than the transverse dimensions of the individual extraction opening 82 which is associated with this article.

In the example of FIGS. 1, 3 and 5, the individual access openings 76 are arranged along two parallel lines of five units each. It is observed that, when two individual access openings 76 which are contiguous on the same line are considered, the rings 84 associated with these two individual access openings 76 are joined by a common edge 86. The common edge 86 is preferably a portion of the precut line 80, and still more preferably, the common edge 86 is a portion of the precut line 80 which is entirely cut in order to ensure that, when a first of the two rings 84 is detached from the transverse plate 74 at the time of the extraction of the corresponding individual article, the other of the two rings, joined to the first, is not subject to any force coming from the first ring 84 and that would risk causing the detachment of this second ring. However, the common edge 86 could be a portion of the precut line 80 that is not entirely cut, having therefore, along the common edge 86, connection points between the joined rings 84 associated with these two contiguous individual access openings 76, but preferably with a minimal tear strength. Furthermore, it is observed that, in this example, when two individual access openings 76 that are not on the same line are considered, the rings 84 respectively associated with these two individual access openings 76 are not joined and therefore do not have a common edge.

In others embodiments, such as that illustrated in FIG. 4 and FIG. 7, at least one individual precut system 78 only partially surrounds the associated individual access opening 76 and delimits, in the transverse plate 74 of the use indicator insert 70, at least one leaf 88 which, after breaking of the precut line or lines 80, remains attached to the transverse plate 74 by a non-precut connection region, while being able to pivot around a fold line 90 which extends transverse to the connection region. By pivoting, the one or more leafs 88 transform the individual access opening 76 into an individual extraction opening 82 allowing the individual article 12 to be extracted.

In the example of FIGS. 4 and 7, it is observed that each individual access opening 76 is surrounded by two leafs 88. Each leaf is delimited by precut lines 80 and by a fold line 90 in a non-precut connection region which ensures that the leaf 88 remains integral with the opening indicator insert 70 even when the precut lines 80 of the individual precut system are broken. Each leaf 88 therefore has an edge which is formed by a portion of the edge of the associated individual access opening 76. In the example, the two leafs 88 are arranged diametrically opposite, on each side of the individual access opening 76. Before breaking the individual precut system 78, the two leafs 88 are connected to one another by a junction edge 92 common to the two leafs, this junction edge 92 itself also being produced in the form of a precut line which is caused to break in order, during the extraction of an individual article, to enable the separation of the two leafs 88 associated with a given individual access opening 76. Indeed, it is noted that the fold lines 90 of the two leafs associated with a given individual access opening 76 are arranged on either side of the individual access opening 76 considered. By contrast, the junction edge 92 of the two leafs extends in a diametric direction relative to the individual access opening 76. In the illustrated example, the junction edge 92 of the two leafs 88 associated with an individual access opening 76 is substantially parallel to the two fold lines 90 of these two leafs 88.

The fold line 90 of each leaf 88 is preferably a premarked fold line, produced for example in the form of a crease in the cardboard, but this is not compulsory.

In the example of FIGS. 4 and 7, the individual access openings 76 are arranged along two parallel lines of five units each. It is observed that, when two individual access openings 76 which are contiguous on a given line are considered, two leafs 88 each associated with these two individual access openings 76 are joined by a common edge 94. The common edge 94 is preferably a portion of the precut line 80, and still more preferably, the common edge 94 is a portion of the precut line 80 which is entirely cut in order to ensure that, when a leaf 88 associated with one of the individual access openings 76 is pivoted relative to the transverse plate 74 at the time of extraction of the corresponding individual article, the other of the leafs 88, joined to the first leaf but associated with the second individual access opening 76, is not subject to any force coming from the first leaf 88 and which would risk causing it to pivot relative to the plane of the transverse plate 74. However, the common edge 94 could be a portion of the precut line 80 which is not entirely cut, having therefore, along the common edge 94, connection points between the joined leafs 88 associated with these two contiguous individual access openings 76, but preferably with a minimal tear strength. Furthermore, it is observed that, in this example, when two individual access openings 76 are considered which are not on the same line, the leafs 88 respectably associated with these two individual access openings 76 are not joined, and therefore do not have a common edge.

In general, a use indicator insert can comprise individual precut systems 78 of different geometries from one another, in particular in the case of packaging 10 for receiving individual articles of several types within the same packaging. Typically, such individual precut systems 78 with different geometries can have one or more precut lines of different geometries between two individual precut systems 78. For example, a given opening indicator insert may have one or more individual precut systems 78 having the geometry illustrated in FIG. 3, and one or more individual precut systems 78 having the geometry illustrated in FIG. 4.

In order that the extraction of the individual article 12 ensures the breaking of the individual precut system 78, anchoring means are advantageously provided for ensuring the anchoring of the use indicator insert 70 in the packaging case 20. These anchoring means can take various forms, in particular one or other or a combination of the following forms. Firstly, the anchoring means can include gluing or stapling of the use indicator insert 70 in the packaging case 20. In other embodiments, when the opening indicator insert 70 is produced in a single piece with the blank 24 from which the packaging case 20 is formed, the anchoring means can be constituted, at least in part, by a connection region between the opening indicator insert 70 and the packaging case 20. However, in the illustrated embodiments, the anchoring means comprise at least one anchoring tab 140, integral with one among the use indicator insert and another element of the packaging 10, and an anchoring slot 142 arranged in the other among the use indicator insert and the other element of the packaging 10, this other element of the packaging 10 being able to be, for example, the packaging case 20 itself or even the enclosure 22 or, as will be seen below, an internal element such as an internal wedging.

In the packaging example 10 illustrated in the figures, the packaging 10 comprises at least one internal wedging 100, 120 which is obtained from at least one blank cut from a sheet of cardboard. It will be seen, more particularly, that in the illustrated example, the packaging 10 comprises a lower internal wedging 100 and an upper internal wedging 120. In the two cases, the internal wedging 100, 120 is received in the inner space of the packaging case 20. More precisely, it is received in the lower portion 72 of the inner space of the packaging case. In all cases, the internal wedging 100, 120 has a number of wedging shapes 102, 122 corresponding to the determined number of individual articles. These wedging shapes 102, 122 have a geometry matched to that of the individual article 12 in order to receive and wedge the latter in the packaging, in particular during transport. Each wedging shape 102, 122 is suitable for wedging the individual article 12 in at least one spatial direction, in particular in a transverse direction of the packaging, but also optionally, in addition or as an alternative, in the longitudinal direction of the packaging 10.

Preferably, the internal wedging 100, 120 determines a position and an orientation of each individual article 12 relative to an individual access opening 76 which is associated with this individual article 12 by the internal wedging. In the example, the internal wedging 100, 120 determines a position of each syringe and a longitudinal orientation of each syringe 12 relative to an individual access opening 76 associated with this syringe 12 such that the piston 16 projects above the opening indicator insert 70, through the associated individual access opening.

In the example illustrated in the figures, the packaging 10 therefore comprises a lower internal wedging 100 and an upper internal wedging 120 which have a similar structure. The upper internal wedging 100 is arranged, in the inner space of the packaging, above the lower internal wedging 100.

The lower internal wedging 100 has a transverse plate 104 intended to be oriented in a plane perpendicular to the longitudinal direction of the packaging. In the transverse plate 104, the wedging shapes are produced in the form of orifices 102, the cross-section of which corresponds to the cross-section of the individual article 12, in this case more particularly the cross-section of the body 14 of the corresponding syringe 12. When an individual article 12 is in the packaging, it is received in the wedging shape 102 of the lower internal wedging 100, so as to be held here in the two transverse directions of the packaging 10.

In the illustrated example, the lower internal wedging 100 is produced in a single piece with the cut blank 24 from which the enclosure 22 of the packaging case 20 is obtained. According to an advantageous aspect, illustrated more particularly in FIG. 2 and in FIG. 6, the lower internal wedging 100 is arranged, in the blank 24, in the extension of the lower flap 62.3 which is associated with the front main panel 26.3. In the example, this lower flap 62.3 therefore extends from the lower edge 40.3 of the front main panel 26.3 to an opposite parallel edge 106 and has, between these two edges, a dimension which is equal to the transverse dimension of the side panel 26.4, which corresponds to a dimension of the enclosure 22 that can be referred to as the transverse depth. In this way, when the packaging case 20 is assembled, therefore when the lower flap 62.3 is folded over at an angle of 90 degrees in a transverse plane perpendicular to the longitudinal direction of the packaging 10, the lower flap 62.3 partly forms the bottom of the packaging case 20 and the opposite parallel edge 106 comes into contact, or almost into contact, with the rear main panel 26.1. It can be seen that the transverse plate 104 of the lower internal wedging 100 is connected to the opposite parallel edge 106 of the lower flap 62.3 by an intermediate lower panel 108. This intermediate lower panel 108 is intended to be folded upwards through 90° relative to the lower flap 62.3 such that, when the packaging case 20 is assembled, the intermediate lower panel 108 extends vertically in a longitudinal plane parallel to the rear main panel 26.1, in parallel and in contact therewith. The transverse plate 104 of the lower internal wedging 100 is connected to the intermediate lower panel 108 at a rear width edge 110, and it is itself intended to be folded through 90° to the horizontal relative to the intermediate lower panel 108 around the rear width edge 110, in the same direction of rotation as the folding of the intermediate lower panel 108 relative to the lower flap 62.3. Hence, the transverse plate 104 of the lower internal wedging 100 extends in a transverse plane perpendicular to the longitudinal direction of the packaging 10, being longitudinally offset, towards the interior of the inner space, in this case upwards, relative to the bottom of the packaging case, by a distance equal to the dimension of the intermediate lower panel 108 between the opposite parallel edge 106 of the lower flap 62.3 and the rear width edge 110. At a front width edge 112 of the transverse plate 104, parallel and opposite to the rear width edge 110 relative to the transverse plate 104 of the lower internal wedging 100, the latter has a fixing flap 114 for fixing the internal wedging which, after folding through 90°, for example upwards, can be fixed, for example by gluing, on an inner face of the front main panel 26.3. The transverse plate 104 of the lower internal wedging 100 has, between its rear width edge 110 and its front width edge 112, substantially the same transverse depth dimension as the inner space of the enclosure 22 of the packaging case 20, so as to be wedged in this transverse depth direction in the inner space of the case 20. After fixing the fixing flap 114, the transverse plate 104 of the lower internal wedging 100 is also wedged longitudinally in this inner space, on the one hand, at the front by the fixing flap 114 which is fixed on the front main panel 26.3 and, on the other hand, at the rear by the intermediate lower panel 108. The fixing flap 114 could be replaced by a support flap folded downwards in parallel and in contact with the inner face of the front main panel 26.3, as will be described below for the upper internal wedging 120.

The upper internal wedging 120 has a transverse plate 124 intended to be oriented in a plane perpendicular to the longitudinal direction of the packaging. In the transverse plate 124, the wedging shapes are produced in the form of orifices 122, the cross-section of which corresponds to the cross-section of the individual article 12, in this case more particularly the cross-section of the body 14 of the corresponding syringe 12. When an individual article 12 is in the packaging, it is received in the wedging shape 122 of the upper internal wedging 120, so as to be held here in the two transverse directions of the packaging 10.

In the illustrated example, the upper internal wedging 120 is produced in a single piece with the cut blank 24 from which the enclosure 22 of the packaging case 20 is obtained. According to an advantageous aspect, visible more particularly in FIG. 2 and in FIG. 6, the lower internal wedging 120 extends in the blank 24, from the upper edge 38.3 of the front main panel 26.3. Firstly it has an upper intermediate panel 128 which extends from the upper edge 38.3 of the front main panel 26.3 to a front width edge 130. The upper intermediate panel 128 is folded downwards through an angle of 180 degrees, against an inner face of the front main panel 26.3. The transverse plate 124 of the upper internal wedging 120 is connected to the upper intermediate panel 128 at the front width edge 130, and it is itself intended to be folded through 90° relative to the upper intermediate panel 128 around the front width edge 130, to the horizontal, in the direction of rotation opposite to the direction of folding of the upper intermediate panel 128 relative to front main panel 26.3. Hence, the transverse plate 124 of the upper internal wedging 120 extends in a transverse plane perpendicular to the longitudinal direction of the packaging 10, being longitudinally offset, towards the interior of the inner space, therefore in this case downwards, relative to the upper edge 38.3 of the front main panel 26.3 of the packaging case, by a distance equal to the dimension of the upper intermediate panel 128 between the upper edge 38.3 of the front main panel 26.3 and the front width edge 130. At a rear width edge 132 of the transverse plate 124, parallel and opposite to the front width edge 130 relative to the transverse plate 124 of the upper internal wedging 120, this latter has a support flap 134 of the upper internal wedging 130 which, after folding through 90°, in this case downwards, can be slid parallel to and in contact with an inner face of the rear main panel 26.1, between the rear main panel 26.1 and the intermediate lower panel 108 of the lower internal wedging 100, in order to come to abut by a free edge 136 against the bottom of the case 20. The transverse plate 124 of the upper internal wedging 120 has, between its front width edge 130 and its rear width edge 132, substantially the same transverse depth dimension as the enclosure 22 of the packaging case 20, so as to be wedged in this transverse depth direction in the inner space of the case 20. After the abutment of the support flap 134 against the bottom of the case 120, the transverse plate 124 is also longitudinally wedged in this inner space, on the one hand at the rear, by the support flap 134 which is in abutment at the bottom of the case 20, and on the other hand, at the front by the upper intermediate panel 128. It is noted that, instead of the support flap 134, the upper internal wedging 120 could be provided with a fixing flap analogous to that of the lower internal wedging 100, which, after folding through 90° (upwards or downwards) could be fixed, for example by gluing, on an inner face of the rear main panel 26.1.

It can be seen in the illustrated example, in particular in FIGS. 1, 2 and 5, that the upper internal wedging 120 also comprises side flaps 138 which extend from the side edges of the transverse plate 124. The side flaps 138 are intended to be folded through an angle of 90° upwards relative to the transverse plate 124 in order to extend upwards along each of an inner face of one of the main side panels 26.2, 26.4 of the case 20. Advantageously, their size can be such that they extend up to the upper edge 38.2, 38 of the corresponding main side panel. In this way, when the upper leaf 52 is closed, the side flaps 138 are blocked from moving upwards by the upper leaf 52 and thus block the upward movement of the transverse plate 124 of the upper internal wedging 120.

In the presence of an internal wedging 100, 120, the anchoring means advantageously ensures a connection between the use indicator insert 70 and the internal wedging 100, 120 in order to ensure the anchoring of the use indicator insert 70 in the packaging case 20. Indeed, by anchoring the use indicator insert 70 on an internal structure inside the inner space delimited by the enclosure 22 of the packaging case 20, it is possible to produce a simpler mounting of the use indicator insert 70, not impacting on the enclosure 22. In the example comprising a lower internal wedging 100 and an upper internal wedging 120, the latter being arranged above the lower internal wedging 100, the anchoring means advantageously ensure a connection between the use indicator insert 70 and the upper internal wedging 120 in order to ensure the anchoring of the use indicator insert 70 in the packaging case 20. It is understood that the use indicator insert 70 is arranged above the upper internal wedging 120 in the packaging case 20.

In the example, the anchoring means comprise at least one anchoring tab 140, integral with one among the use indicator insert 70 and the internal wedging (in the example the upper internal wedging 120), and an anchoring slot 142 arranged in the other among the use indicator insert 70 and the internal wedging 120. The anchoring tab 140 comprises an anchoring shape enabling the insertion of the anchoring tab 140 in the anchoring slot 142 and opposing the withdrawal of the anchoring tab relative to the anchoring slot 142.

In the illustrated examples, the anchoring tabs 140 each extend in the extension of a side flap 144 of the use indicator insert 70 which extends itself from a side edge 146 of the transverse plate 74 of the use indicator insert 70. The side flap is intended to be folded through 90° relative to the transverse plate 74 of the use indicator insert 70, to the vertical downwards. In the example, it is envisaged that the lower edge 148 of each side flap 144 of the use indicator insert 70 comes into contact downloads on the transverse plate 124 of the internal wedging, in this case the upper internal wedging 120. This support of the side flaps 144 on the transverse plate 124 of the internal wedging makes it possible to position and stabilise the opening indicator insert 70 in the inner space of the packaging.

In the illustrated example, the anchoring tab 140 extends from the lower edge 148 of the corresponding side flap 144 of the opening indicator insert 70. For example, the anchoring tab 140 has the shape of a flat arrow in the plane defined by the corresponding side flap 144. The anchoring tab 140 can thus have an arrow tip 147 which is attached to the lower edge 148 of the corresponding side flap by an arrow stem 149. The arrow tip is pointed away from the lower edge of the corresponding side flap 144.

For its part, each anchoring slot 142 is arranged at a side edge 126 of the transverse plate 124 of the upper internal wedging 120, in this case a side edge 126 from which the side flap 138 of the upper internal wedging 120 extends.

FIGS. 8 and 9 show a particularly advantageous configuration of the anchoring slot 142. This configuration will be described in the illustrated case, in which the anchoring slot is arranged on an upper internal wedging 120, the anchoring tab 142 being carried by the opening indicator insert 70. However, an analogous configuration is possible in the inverse case, with the anchoring slot 142 arranged on the opening indicator insert 70 and the anchoring tab 140 arranged on an internal wedging.

Indeed, the anchoring slot 142 is arranged at a side edge of a transverse plate 124, in this case that of the upper internal wedging 120, from which a flap extends, in this case the side flap 138, which is folded through 90° by folding along a fold line which corresponds to the side edge 126. This side edge 126 defines a fold line having a folding axis A126. The flap, in this case the side flap 138, is folded over towards the direction from which the anchoring tab 140 must be inserted into the anchoring slot 142. FIG. 8 illustrates an embodiment of the anchoring slot 142 at the fold line of the side edge 126. It can be seen that the anchoring slot 142 comprises a central lumen 160, which has a certain width in the direction perpendicular to the folding axis A126. This width is, for example, several millimetres, in any case greater than the thickness of the cardboard in which the anchoring tab 140 is produced. The central lumen 160 has a size, in the direction of the folding axis A126, which is greater than that of the arrow stem 149 of the anchoring tab 140, but less than the size, in the direction of the folding axis A126, of the arrow tip 147. On each side of the central lumen 160 in the direction of the folding axis A126, the anchoring slot 142 has junction cuts 162 which join the corresponding end of the central lumen 160 to the fold line 126. These junction cuts 162 are preferably produced in the form of a simple cut line in the cardboard. These junction cuts 162 have a size, in the direction of the folding axis A126, which is such that the total size of the anchoring slot in this direction is at least equal to that of the arrow tip 149 of the anchoring tab 140. Hence, the arrowhead 149 is able to be inserted through the anchoring slot 140 without being deformed. As can be seen in FIG. 8, the junction cuts 162 have an offset relative to the folding axis A126, in the direction of the flap 138, in order to define transverse projections 164 of the transverse plate which extend the transverse plate 124 beyond the folding axis A126. In the illustrated example, the offset of the junction cuts 162 is in the form of an inclination of each junction cut 162 relative to the folding axis A126 in the plane of the transverse plate 124. In the illustrated example, each junction cut 162 is produced in the form of a segment, in this case a straight segment, which has a distal end 162*d* which joins the fold line 126 on the folding axis A126, and a proximal end 162*p* which opens into the central lumen 160 and which is offset relative to the folding axis A126 in the direction of the flap 138. It is understood that, when the flap 138 is folded over perpendicularly to the transverse plate 124, as illustrated in FIG. 9, it is aligned with the folding axis A126. By contrast, as can be seen in FIG. 9, the transverse projections 164, which are each separated from the flap 138 by the corresponding junction cut 162, remain in the plane of the transverse plate 124 and extend beyond the folding axis 126. In the described configuration, in which the flaps 138 are folded over upwards, the projections 164 are then below the flap plane 138. When the anchoring tab 140 is inserted in the anchoring shape 142, in this case from above, the transverse ends of the arrow tip 147 slide under the transverse projections 164. Any force exerted on the anchoring tab 140 in the direction of its extraction from the anchoring slot 142 means that the transverse ends of the arrow tip 147 come into abutment from the bottom against the transverse projections 164. However, these projections 164 are blocked from moving upwards by the flap 138 which is folded over upwards and they therefore prevent any deformation of the transverse plate 124 which could enable an extraction without damage to the arrow tip 147. This configuration of the anchoring slot 142 is therefore particularly advantageous because it enables easy insertion of the anchoring tab, by deforming the transverse projections 164 downwards, a deformation which is not counteracted. On the contrary, any upward deformation of the transverse projections 164 is counteracted by the abutment of these transverse projections 164 against the edge of the flap 138 folded over upwards.

Furthermore, it is noted that in the illustrated examples, the use indicator insert 70 also comprises a front flap 150 and a rear flap 152 which each extend respectively from a front edge 154 and a rear edge 156 of the transverse plate 74 of the use indicator insert 70, which are each intended to be folded through 90° relative to the transverse plate 74 of the use indicator insert 70. Such 90° flaps make it possible to rigidify the use indicator insert 70. Optionally, such flaps can be folded vertically downwards, and they are sized such that a lower edge 158, 160 of each front flap 150 and rear flap 152 of the use indicator insert 70 comes into abutment downwards on the transverse plate 124 of the internal wedging, in this case the upper internal wedging 120. In this case, this abutment also makes it possible to position and stabilise the opening indicator insert 70 in the inner space of the packaging. In the examples illustrated, the front 150 and rear 152 flaps do not have an anchoring tab, but it could be provided that they have, in addition or as an alternative, anchoring tabs 142 carried by the side edges 144.

Advantageously, the use indicator insert 70 is arranged in the packaging at a predetermined non-zero distance from the upper longitudinal end of the enclosure 22, towards the interior in the longitudinal direction. This makes it possible, in particular, that the individual articles have a portion which projects above the opening indicator insert, without leaving the volume of the inner space of the packaging. Thus by projecting above the opening indicator insert 70, the articles can be easily grasped by the user.

In certain embodiments, the use indicator insert 70 can also be obtained from the same blank as the packaging case 20. For example, starting from the blank 24 illustrated in FIG. 2, it is possible to have a use indicator insert 70, for which the transverse plate 74 of the use indicator insert would be connected, via an intermediate panel, to an upper edge 40.*i* of one of the main panels. This intermediate panel would form a part of the anchoring means, it being possible to form another part for example, in an analogous manner to that which has been described above, by an anchoring tab carried by a flap arranged opposite the intermediate panel relative to the transverse plate 74. Such a configuration is compatible with a case 20 comprising both a lower internal wedging 100 and an upper internal wedging 120 as described above. Indeed, it would be possible to have a use indicator insert 70 for which the transverse plate 74 of the use indicator insert would be connected, via said intermediate panel, to the upper edge 38.2, 38.4 of one or other of the main side panels 26.2, 26.4. In the case of a packaging case not comprising any upper internal wedging incorporated in the same blank as the enclosure 22 of the case 20, it is possible that the transverse plate 74 of the use indicator insert is connected, via said intermediate panel, to the upper edge 38.2, 38.4, 38.3 of one or other of the main side panels 26.2, 26.4 or of the front main panel 26.3, the use indicator insert which would take the place, in the blank 24, of the upper internal wedging. In such a case therefore, in the absence of upper internal wedging, it would be possible to provide, for example, the anchoring means ensuring a connection between the use indicator insert and the lower internal wedging.

The use indicator insert does not necessarily absolutely guarantee detection of a prior extraction of a considered article. However, in particular through a judicious choice of relative shapes and strengths, in particular relative strength of the precut lines 80, the use indicator insert can constitute a tamper indicator device for the individual article.

The invention claimed is:

1. A packaging (10) for packaging a determined number of individual articles, the packaging comprising:

a. a packaging case (20) having:

i. an enclosure (22)

1. Which is obtained by folding at least one blank (24) cut from a sheet of cardboard,
2. which is tubular in a longitudinal direction,
3. which has, in a transverse plane perpendicular to the longitudinal direction, a closed polygonal transverse contour around an inner space of the packaging case (20),
4. which comprises an upper opening (50) at an upper longitudinal end of the enclosure and a lower closure (60) at a lower longitudinal end of the enclosure;

characterised in that the packaging (10) also comprises:

b. a use indicator insert (70)

i. which is received in the inner space of the packaging case (20) above a lower portion of the inner space, the lower portion of the inner space being intended to receive the individual articles, ii. which comprises a transverse plate (74) extending perpendicularly to the longitudinal direction of the enclosure of the packaging case (20), the transverse plate (74)

1. being obtained from at least one blank cut from a sheet of cardboard,
2. having the same number of individual access openings (76) for an individual article, as the determined number of individual articles,
3. And having, around each individual access opening (76), an individual precut system (78) which at least partially surrounds the associated individual access opening (76) and which comprises at least one or more precut lines (80), each individual precut system (78) determining, after breaking of the precut line or lines (80), an individual extraction opening (82) which encompasses the individual access opening (76) and which has at least one transverse extraction dimension which is greater than a corresponding transverse dimension of the corresponding individual access opening (76), c. anchoring means (140, 142) for ensuring the anchoring of the use indicator insert (70) in the packaging case (20).

2. The packaging according to claim 1, characterised in that at least one individual precut system (78) completely surrounds the associated individual opening (76).

3. The packaging according to claim 2, characterised in that at least one individual precut system (78) comprises a precut line (80) which completely surrounds the associated individual access opening (76) and which delimits, in the transverse plate (74) of the use indicator insert (70), a ring (84) which, by breaking the precut line (80), detaches itself from the transverse plate (74).

4. The packaging according to claim 1, characterised in that at least one individual precut system (78) only partially surrounds the associated individual access opening (76) and delimits, in the transverse plate (74) of the use indicator insert (70), at least one leaf (88) which, after breaking of the precut line or lines (80), remains attached to the transverse plate (74) by a non-precut connection region, while being able to pivot around a fold line (90) which extends transverse to the connection region.

5. The packaging according to claim 4, characterised in that the fold line (90) which extends transverse to the connection region is a premarked fold line.

6. The packaging according to claim 1, characterised in that the packaging comprises at least one internal wedging (100, 120) of the individual articles, the internal wedging (100, 120) being obtained from at least one blank cut from a sheet of cardboard, and the internal wedging (100, 120) being received in the inner space of the packaging case (20), and in that the anchoring means (140, 142) ensures a connection between the use indicator insert (70) and the internal wedging in order to ensure the anchoring of the use indicator insert (70) in the packaging case (20).

7. The packaging according to claim 6, characterised in that the anchoring means comprise at least one anchoring tab (140), integral with one among the use indicator insert (70) and the internal wedging (100, 120), and an anchoring slot (142) arranged in the other among the use indicator insert (70) and the internal wedging (100, 120), and in that the anchoring tab (140) comprises an anchoring shape enabling the insertion of the anchoring tab into the anchoring slot (142) and opposing the withdrawal of the anchoring tab relative to the anchoring slot (142).

8. The packaging according to claim 7, characterised in that the anchoring slot (142) is arranged at a fold line (126) between a transverse plate (74) and a flap (138), the fold line (126) defining a folding axis (A126) and the flap (138) being folded over towards the direction from which the anchoring tab (142) must be inserted in the anchoring slot (142), in that the anchoring slot (142) comprises a central lumen (160) and, on each side of the central lumen (160) in the direction of the folding axis (A126), junction cuts (162) which join the corresponding end of the central lumen (160) at the fold line (126), and in that the junction cuts 162 have an offset relative to the folding axis (A126), in a direction of the flap (138), in order to define transverse projections (164) of the transverse plate which prolong the transverse plate (124) beyond the folding axis (A126).

9. The packaging according to claim 6, characterised in that the internal wedging (100, 120) is produced in a single piece with the blank (20) from which the enclosure (22) is obtained.

10. The packaging according to claim 6, characterised in that the internal wedging (100, 120) has a number of wedging shapes (102, 122) corresponding to the determined number of individual articles.

11. The packaging according to claim 6, characterised in that the internal wedging (100, 120) determines a position and an orientation of each individual article (12) with regard to an individual access opening (76) associated with this individual article (12).

12. The packaging according to claim 1, characterised in that the packaging (10) comprises a lower internal wedging (100) and an upper internal wedging (120) arranged above the lower internal wedging (100) in the inner space delimited by the case (20), and in that the anchoring means (140, 142) ensure a connection between the use indicator insert (70) and the upper internal wedging (120) in order to ensure the anchoring of the use indicator insert (70) in the packaging case (20).

13. The packaging according to claim 1, characterised in that the use indicator insert (70) is arranged in the packaging (10) at a predetermined distance from the upper longitudinal end of the enclosure, towards the interior in the longitudinal direction.

14. The packaging according to claim 1, characterised in that the packaging case (20) and the opening indicator insert (70) are each obtained from separate cardboard blanks.

15. The packaging according to claim 1, characterised in that the packaging case (20) and the opening indicator insert (70) are each obtained from a common cardboard blank.

16. An assembly comprising the packaging (10) according to any one of the preceding claims and individual articles (12) contained in the packaging (10), wherein the individual articles (12) have at least one portion (18) which is received in the lower portion (72) of the inner space of the packaging case (20), said at least one portion (18) having a transverse dimension which is greater than a corresponding transverse dimension of the individual access opening associated with the individual article.

17. The assembly according to claim 16, characterised in that the transverse dimensions of each individual article (12) are less than the transverse dimensions of the corresponding individual extraction openings (82).

18. The assembly according to claim 16, characterised in that the individual articles (12) comprise an upper portion (16) which projects above the use indicator insert (70).

* * * * *